US007213291B2

(12) United States Patent
Cheng

(10) Patent No.: US 7,213,291 B2
(45) Date of Patent: May 8, 2007

(54) CLEANING DEVICE

(75) Inventor: Hsu Hung Cheng, Kowloon (HK)

(73) Assignee: Victory Converter Company Limited, Kowloon (HK)

( * ) Notice: Subject to any disclaimer, the term of this patent is extended or adjusted under 35 U.S.C. 154(b) by 388 days.

(21) Appl. No.: 10/784,041

(22) Filed: Feb. 20, 2004

(65) Prior Publication Data

US 2005/0183223 A1 Aug. 25, 2005

(51) Int. Cl.
*A47L 25/00* (2006.01)
*A47L 25/08* (2006.01)

(52) U.S. Cl. ..... 15/104.2

(58) Field of Classification Search ..... 15/104.002
See application file for complete search history.

(56) References Cited

U.S. PATENT DOCUMENTS 2,542,774 A * 2/1951 Hutchinson ..... 15/104.002
3,381,325 A * 5/1968 Reineman ..... 15/104.002
4,905,337 A 3/1990 McKay
4,979,257 A 12/1990 Heneveld

FOREIGN PATENT DOCUMENTS

DE 295 07 878 9/1995
EP 0 680 888 A1 11/1995
WO WO-83/01734 5/1983

* cited by examiner

*Primary Examiner*—Randall Chin
(74) *Attorney, Agent, or Firm*—Blakely Sokoloff Taylor & Zafman LLP

(57) ABSTRACT

A cleaning device that may have a body forming a multi-functional plastic receptacle and that may incorporate features providing easy peel back of one turn of depleted adhesive coated sheet material in the cleaning device and facilitating a neat tearing away of the depleted material. In a preferred embodiment, the body is formed of two body members hinged together to substantially fully enclose a roll of adhesive coated sheet material when snapped closed, and when snapped open, to form a continuous handle-like portion. The roll is slit at one end, which when a full turn of depleted material is peeled back, will allow the slit to align with a sharp, molded-in edge of one of the body members to facilitate tearing off the depleted material, starting at the slit. This also facilitates folding the free end to a double thickness for later easy peel back of the next turn.

17 Claims, 6 Drawing Sheets

FIG. 4
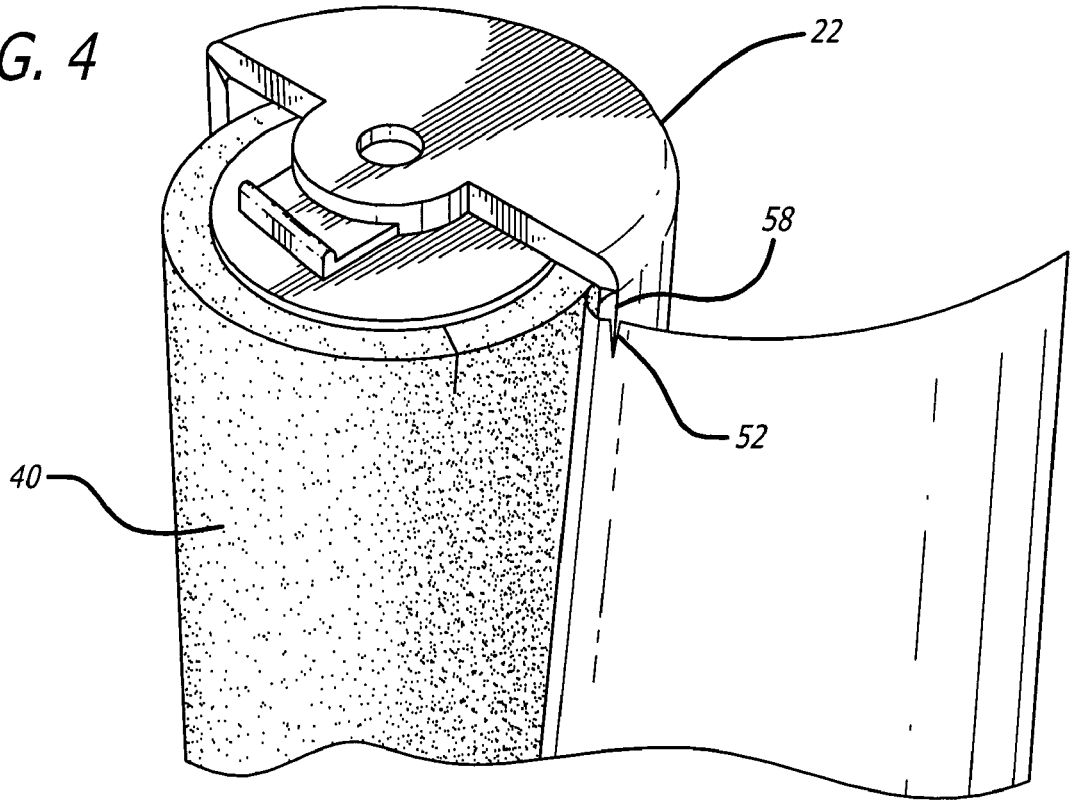
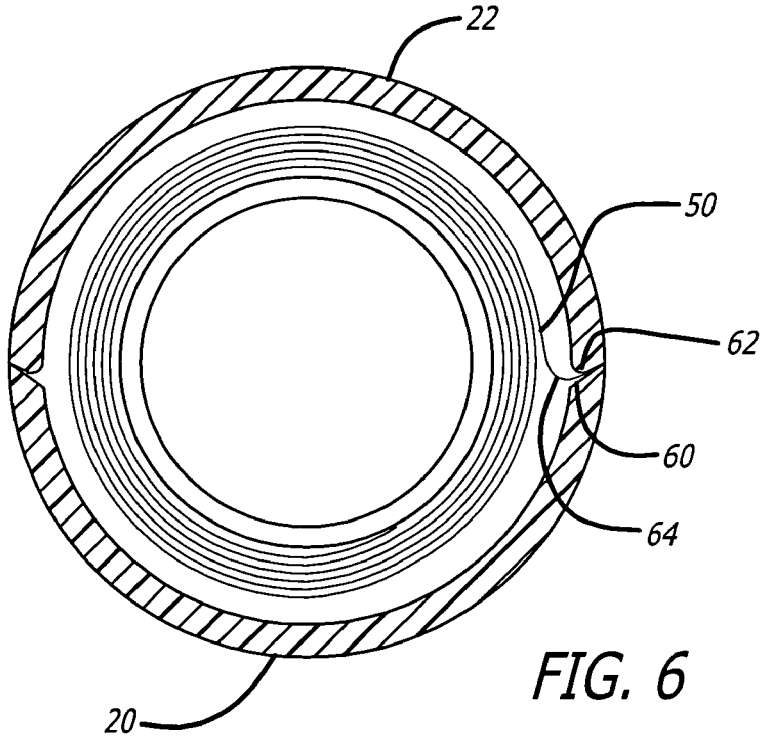
FIG. 6

CLEANING DEVICE

BACKGROUND OF THE INVENTION

1. Field of the Invention

The present invention relates to cleaning devices of a type sometimes referred to a lint removers.

2. Prior Art

Cleaning devices having a roll of adhesive coated sheet material, typically crepe paper, rolled adhesive coated surface outward and mounted for rotation about the axis of the roll are well known. The adhesive coated surface picks up lint, hair, dandruff, etc. when rolled over clothes, furniture, etc. until the adhesive coating looses its effectiveness because of the amount of foreign matter it has picked up. When this occurs, the cleaning ability may be restored by removing the used outer turn of adhesive coated paper to expose a fresh adhesive coated surface.

Although much thought has been given to how to neatly tear away the used adhesive crepe paper, manufacturers are generally not willing to fit sharp metal blades to such devices for reasons of cost and safety. There are two solutions that are found among products of this category. These are to either cut a straight line slightly narrower than the adhesive paper across the adhesive paper roll, or to provide perforated lines in the paper. However the adhesive paper is very thin, and each layer is adhered tightly to the next layer. Therefore it is very difficult to peel away a layer of the paper, especially for users without long fingernails. Furthermore, when the edge of thin adhesive paper is broken in an irregular fashion, it is prone to ripping on the edges when being peeled, making it more difficult to change paper, and possibly even resulting in new adhesive paper underneath also being damaged and wasted.

In order to achieve a thin adhesive paper that is easy to peel away, conventional products of the same category all use complex technology to apply an adhesive substance to the center of the paper backing, leaving the two sides free from adhesive, and making the backing easy to peel away. However, when peeling away and changing the paper, it is easy to tear a single layer of paper, which results in additional trouble.

Also conventional products of the same category are one-piece club-shaped assemblies from the fitting of the adhesive paper to the location of the handgrip and are without a function of folding and opening. They are relatively large in size and also require the addition of a special adhesive protection sheet or coating to cover the adhesive paper, and this presents considerable technical difficulties. The covering and disassembling actions are extremely troublesome and inconvenient. Furthermore, if the protective sheet is lost, there is no way to protect the adhesive paper. Additionally, the smoothness of rotation of the adhesive paper is not as good as that of our company's design.

A lint remover having a sticky soft plastic roller uses a folding housing which folds around the roller for protection when not in use, and which opens to form a handle-like protrusion. The housing does not tightly lock in the open position, nor in the closed position, as it has not catch or lock at the ends opposite the hinge area. Also when in the open position, the surface of the handle-like protrusion does not align with the surface of the other housing part, so that the housing, when open, does not have an aesthetically pleasing appearance.

BRIEF DESCRIPTION OF THE DRAWINGS

FIG. 4 is a view illustrating the unrolling one layer of used adhesive coated sheet material and aligning the slit at one edge thereof with a sharp edge on one of the body members of the device.

FIG. 6 is a cross section illustrating the state of the adhesive coated sheet material after one turn of used material has been torn away.

DETAILED DESCRIPTION OF THE PREFERRED EMBODIMENTS

Figure 1:
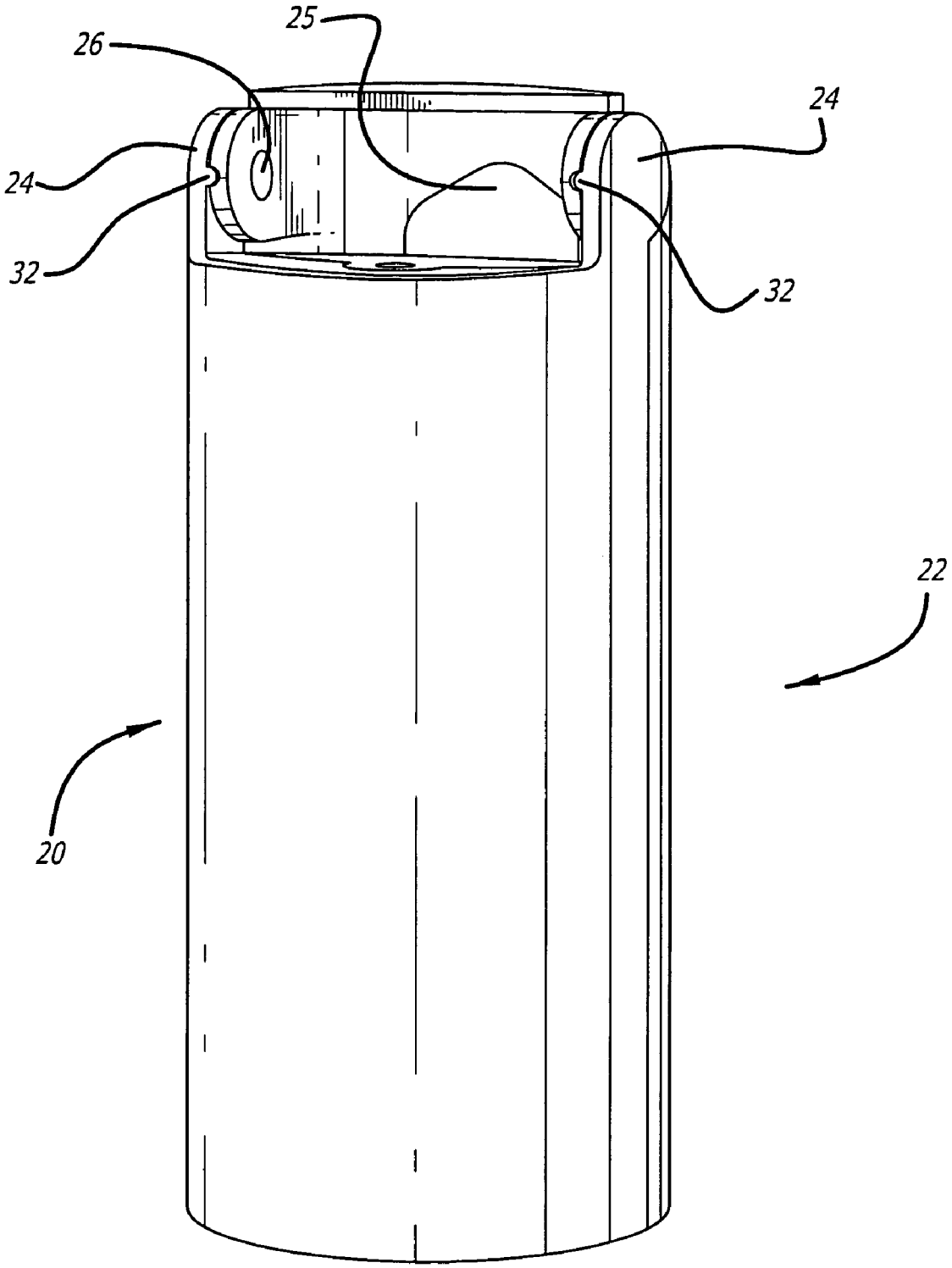
FIG. 1 is a view of one embodiment of a cleaning device in accordance with the present invention.
Figure 2:
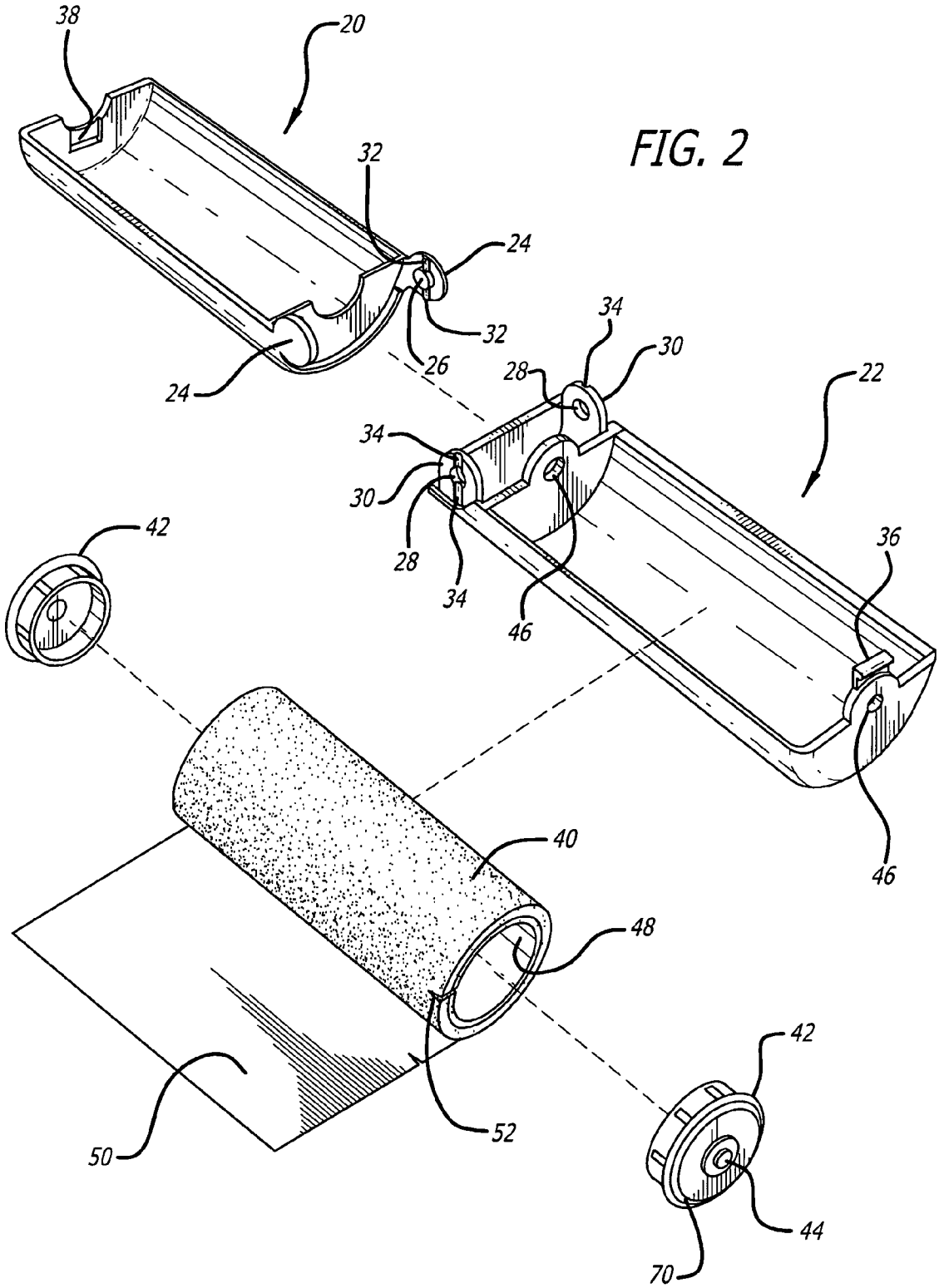
FIG. 2 is an exploded perspective view of the embodiment of FIG. 1.

First referring to FIGS. 1 and 2, a view of one embodiment of the present invention cleaning device in the closed condition and an exploded view of the cleaning device in the open condition, respectively, may be seen. The cleaning device of this embodiment is comprised of first and second body members, generally indicated by the numerals 20 and 22, which when in the closed condition shown in FIG. 1, form a substantially continuous surface along the length of the closed device. In that regard, in the specific embodiment shown, the body members are substantially semicircular, thereby forming a substantially round cross section cylindrical enclosure when closed, as shown in FIG. 1.

The body members are hinged together adjacent the upper end (using the orientation of FIG. 1) with each body member having a pair of hinge members complimentary to the hinge members on the other body member. In the specific embodiment shown, body member 20 has ear shaped hinge members 24 having inwardly projecting hinge pins 26 which may be snapped into holes 28 in projections 30 on body member 22.

Figure 3C:
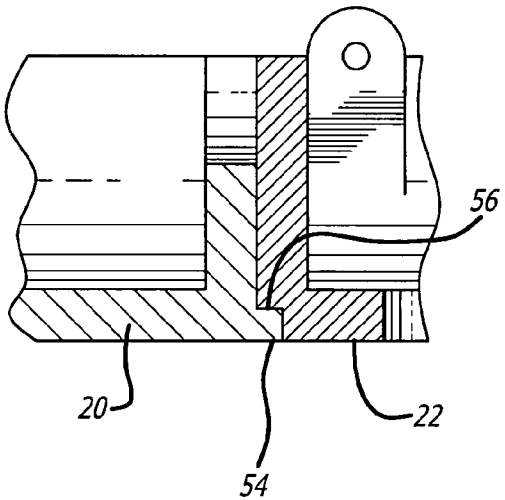
FIG. 3*c* is a local cross section taken along line 3*c*—3*c* of FIG. 3*a*.
Figure 3B:
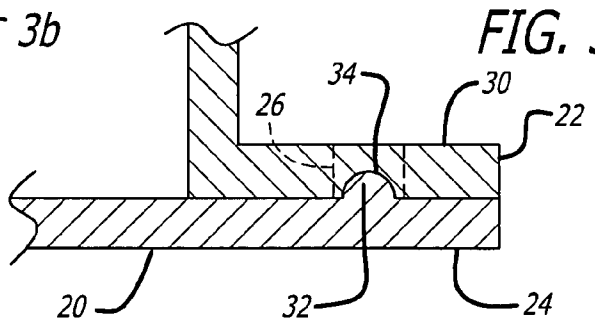
FIG. 3*b* is a local cross section taken along line 3*b*—3*b* of FIG. 3*a*.
Figure 3A:
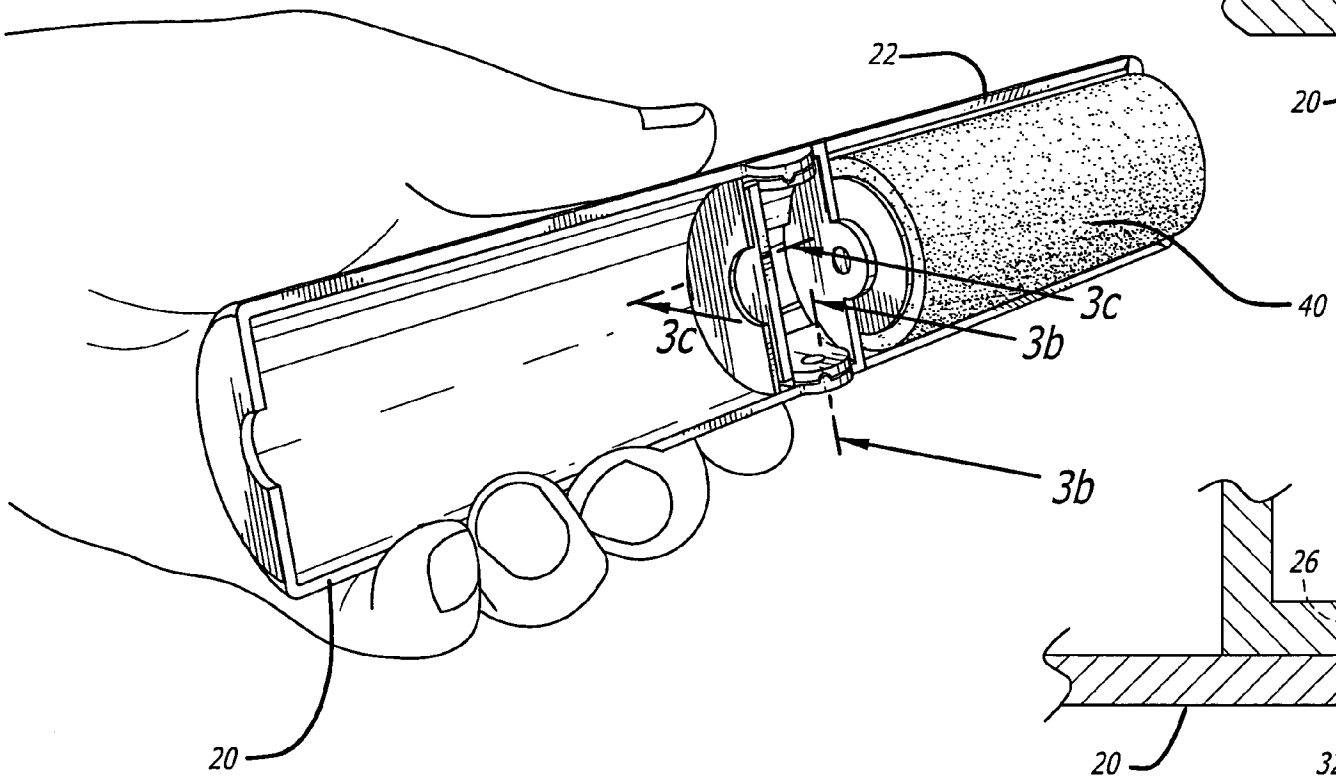
FIG. 3*a* is a view of the cleaning device of FIG. 1 in the open, ready to use condition.

Also visible in FIGS. 1 and 2 are inward projections 32 on the ear shaped hinge members 24 on body member 20, cooperatively disposed with respect to complimentary grooves 34 in projections 30 of body member 22. As may be seen in FIG. 1 and in the cross section of FIG. 3*b* taken along line 3*b*—3*b* of FIG. 3*a*, the projections 32 snap into grooves 34 when the two body members are folded on the hinges to the closed position of FIG. 1, or to the open position as shown in FIG. 3. Also, in the specific embodiment shown, a hook latch member 36 is molded integral with body member 22 to hook onto region 38 of body member 20, thereby providing complimentary snap members for further holding the cleaning device in the closed position shown in FIG. 1. In the preferred embodiment the body members 20 and 22 are injected molded plastic members having adequate flexibility to allow the complimentary hinge parts to snap together and to resist opening from the closed position and closing from the opening position. Similarly, the operation of the complimentary snap members 36 and 38 is facilitated by the flexibility and elasticity of the plastic.

Also partially visible in FIG. 1 is an opening 25 in body member 22. This opening may be used for hanging cleaning devices on a display rack, such as at the point of sale, and for hanging in a users closet if desired.

As may be seen in FIGS. 2 and 3*a*, mounted within body member 22 is a roll of adhesive coated sheet material 40 mounted on reusable end pieces 42 which slip into the ends of the roll 40 and have short, outward extending bearing shafts 44 for snapping within openings 46 in body member 22. The roll 40 in the preferred embodiment is comprised of a tube 48, such as a cardboard tube, with an adhesive coated sheet material 50 rolled adhesive side out on the cardboard 48. In the preferred embodiment, the adhesive coated sheet material is an adhesive coated crepe paper.

As may be seen in FIG. 2, the roll of adhesive coated sheet material 40 has a small slit 52 at one end thereof, the slit 52 going through all layers of the multi-layer roll, typically also going partway, if not all of the way, through the cylinder 48 on which it is rolled.

Figure 7:
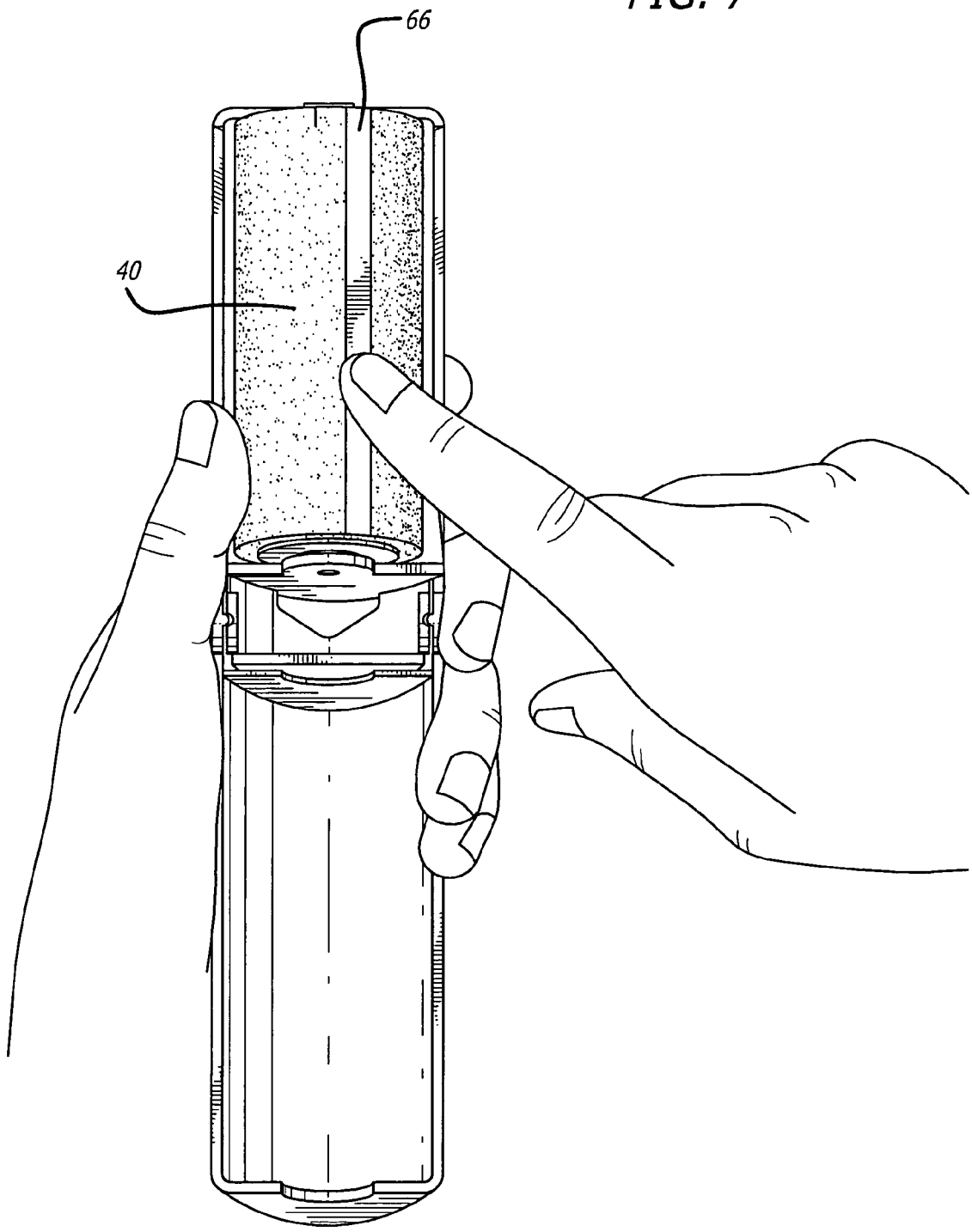
FIG. 7 illustrates the folding back of the free edge of the adhesive coated sheet material after a used portion has been torn therefrom, thereby providing a double thickness edge on the roll of adhesive coated sheet material to facilitate the later unwinding of another layer of used material.

In use, the cleaning device is opened as shown in FIG. 7. The outer contour of the body members 20 and 22 provide a substantially uninterrupted surface, serving both an aesthetic and a functional purpose in that the cleaning device may be comfortably gripped by body member 20, as shown in FIG. 3*a*, or with the user's hand spanning both body members, or if desired, gripping only body member 22. Also when in the open position shown in FIG. 3*a*, a small lip 54 on body member 22 snaps into a complimentary recess in member 20 as shown in FIG. 3*c*. In the preferred embodiment, the parts are made with dimensions such that because of the relative location of the hinge axis defined by complimentary hinge members, there is a slight interference between lip 54 and the leading edge 56 of the recess in body member 20. This further enhances the snap action for snapping the cleaning device open and for retention of the two body members in the open position.

Figure 5:
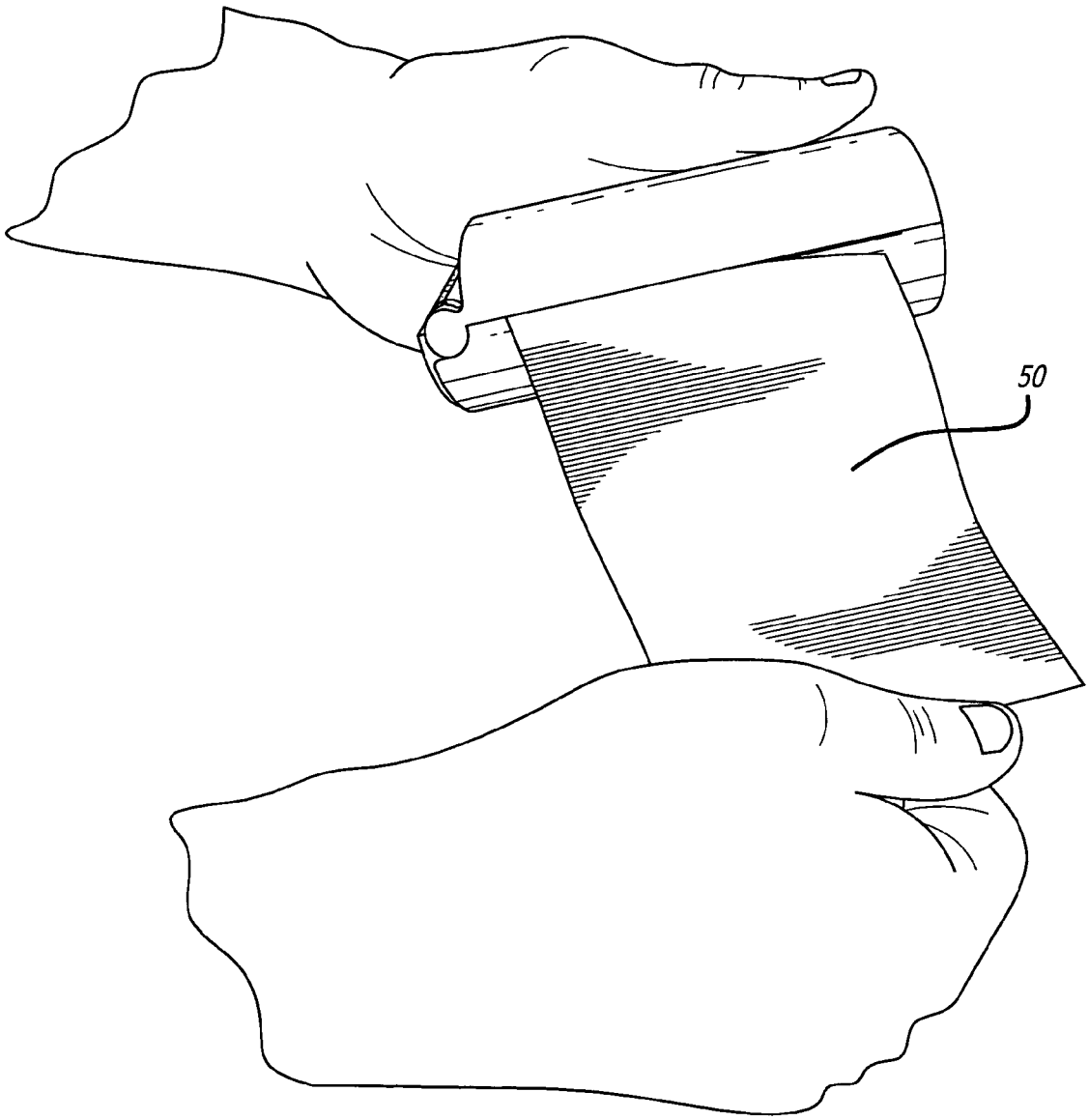
FIG. 5 illustrates the pinching of the adhesive coated sheet material against a sharp edge of one of the body members and the tearing of one layer of used material therefrom.

In use, the adhesive coated roll 40 may be rolled over clothes, furniture, carpets and the like to pick up hair, lint and other debris by the stickiness of the adhesive coated roll 40. After some continued use the roll will begin to lose its stickiness, and accordingly, its efficiency in picking up further debris becomes limited. When this happens, a single turn of sheet material is unrolled from the roll 40 (see FIG. 4) so that the next slit 52 aligns with the outer edge 58 of body member 22. Then the two body members 20 and 22 are closed as shown in FIG. 5. It will be noted from FIG. 6 that one of the body members has a relatively sharp outer edge 60, with the complimentary body member having an incline 62 to cooperatively engage the relatively sharp edge 60. Thus by holding the two body members closed as in FIG. 5, the adhesive coated sheet material 50 is squeezed or pinched between the sides of the two body members. This, in cooperation with the slit aligned with the sharp edge 60 to facilitate initiation of tearing, allows the tearing of exactly one turn of the used adhesive coated sheet material 50, FIG. 6 showing a cross section after the tearing is complete. Now on opening of the cleaning device, the free edge 64 (see FIG. 6) that was pinched between the two body members may freed by rotating the roll, and when freed, the free end of the adhesive coated sheet material may be folded back 180° to form a strip 66 (see FIG. 7) that is folded, adhesive side versus adhesive side, to create a double thickness leading edge on the roll. While this creates a narrow strip of the uncoated side of the sheet material across the adhesive coated roll 40, it is relatively narrow and has very little effect on the cleaning ability of the adhesive coated roll. However, once the newly exposed turn of adhesive coated sheet material becomes depleted through use, the double thickness leading edge of that layer is very much less prone to ripping, thereby greatly facilitating the peeling of an additional turn from the roll for tearing off, etc. to expose still another fresh adhesive coated surface.

Thus the structure and operation of the product has many differences and advantages over conventional products of the same category. The preferred embodiment is comprised of a cylindrical receptacle using a roll of adhesive crepe paper, the ends of which are fitted with round plastic fasteners and then enclosed by two plastic casings. Utilizing the sticking power of the adhesive paper, lint, fibers, hair, dandruff and scraps of paper that have fallen onto clothing, pillows, fabric covered furniture and fabric covered car seats can be rolled clean. It can also be used for cleaning away mess left behind by pets, such as dog or cat hairs, etc.

The product's innovative features include a new method for neatly tearing the adhesive coated sheet material, preferably adhesive coated paper. Specifically, a small cut or slit is pre-cut on the edge of the roll of adhesive paper so that when the adhesive paper is covered in lint and other residue and begins to lose its adhesive effect, users can peel the used adhesive paper back to the small cut at the position of a sharp angle edge on the receptacle. Closing the receptacle refastens the adhesive paper. Users can tear away used adhesive paper by hand from the point of the small cut and a tidy tear of the adhesive paper can be achieved without using sharp blades.

The product's innovative features also include a new method for the perfect formation of easy peeling of the adhesive coated paper. After completing the key action of neatly tearing away the adhesive paper, one can open the receptacle and use their hand to rotate the adhesive paper slightly in a pulling out direction, enabling the neat tear of the adhesive paper to leave the sharp angled edge of the receptacle. This also enables one to obtain just the right length of adhesive paper to match the casing.

After that, the free end of the roll of adhesive paper is wound back to perfectly form a paper head the thickness of two layers of adhesive. This not only allows users to peel away and change paper easily, but also greatly increases the strength of the paper edge, preventing it from ripping when attempting to peel back another layer. Without using this method, because the adhesive paper is very thin and is adhered tightly to the lower layer, it would be very difficult to peel away paper, especially so for users without long fingernails. Furthermore, when the edge of thin adhesive paper is broken in an irregular fashion, it is prone to ripping on the edges when being peeled, making it more difficult to change paper and possibly even resulting in new adhesive paper underneath also being damaged and wasted.

The product's innovative features further include an original multi-functional plastic receptacle. When the receptacle is opened 180 degrees, the body members work together with ergonomic principles and can be used as a gripping handle. The hidden locking fastener inside the receptacle is both easy to open and can be closed tightly in all safety. It also provides the greatest level of protection against adhesive sticking to unwanted areas when not in use, and dust, lint and other floating substances in the air sticking to the adhesive paper and reducing its adhesive effect. Also the contact area between the rotating axle centers of the fasteners or reusable end caps 42 supporting the roll of adhesive paper is very small and has a low friction coefficient, allowing the adhesive paper to roll extremely smoothly and easily.

The method used by the sharp angled edge of the receptacle and the casing to grip the adhesive paper allows for the neat breaking of paper and also allows the leading edge of the paper to stand up in a regular fashion. This enables users to easily bend back and form a leading edge that can be easily peeled away.

When the adhesive characteristics of the outer layer of the roll of adhesive paper is depleted and needs to be replaced, one can use their fingers to grasp the two circular fasteners to take off the paper core. In that regard, the outer surface 70 (see FIG. 2) of the reusable end caps 42 is intentionally patterned in some way to provide a non-slip gripping surface. The two circular fasteners 42 can then be fitted to a new roll of adhesive paper and that assembly fastened into the body member 22 by first inserting one bearing shaft 44 (FIG. 2) into one of the openings 46 in body member 22, and then squeezing the other fastener into the remaining opening 46.

The opening joint of the receptacle is made up of two ear-shaped fasteners that fasten to the two openings on the other half of the receptacle and allow a 180-degree opening action. At the same time, the inherent elasticity of plastic is utilized in an arched channel that extends out and prevents the handgrip from swinging freely when fastened. To close the receptacle, one merely has to fold the handgrip gently by hand and it will release and close. The shape of the receptacle is pocket-sized and not awkward. It can be stably placed in a vertical position and can also be hung from a hole. These features make it very convenient to display, carry or store.

A new and unique cleaning device having a number of features has been disclosed herein. However it is to be understood that each of these features may be advantageously practiced alone, or practiced in various combinations and sub-combinations in products of the described type. Thus while a preferred embodiment of the present invention has been disclosed and described herein, it will be understood by those skilled in the art that various changes in form and detail may be made therein without departing from the spirit and scope of the invention.

What is claimed is:

1. A cleaner comprising:

first and second body members, each having first and second ends, the first and second body members being hinged together at their first ends to fold together about the hinge to abut along first and second sides of the body members to define an enclosure having an outer surface defined by the outer surfaces of the first and second body members, and to open about the hinge so that the outer surfaces of the first and second body members define a substantially continuous surface, the first and second body members having complementary snap members on their second ends to snap together when folded together to form the enclosure;

a roll of adhesive coated sheet material, rolled adhesive coated side out, partially within the first body member and supported from the first and second ends of the first body member for rotation about its axis;

the roll of adhesive coated sheet material being slit adjacent one end thereof;

at least one side of one of the body members defining a sharp edge for pinching the roll of adhesive coated sheet material between the sharp edge and an adjacent side of the other body member to encourage tearing of the adhesive coated sheet material along the sharp edge when the adhesive coated sheet material is unrolled to place one of the slits in the roll adjacent the sharp edge.

2. The cleaner of claim 1 wherein the first and second body members are injection molded members and the sharp edge is a molded sharp edge.

3. The cleaner of claim 1 wherein the first ends of the first and second body members are configured to snap together to hold the body members in the open position.

4. The cleaner of claim 1 wherein both sides of one of the body members defines a sharp edge.

5. The cleaner of claim 4 wherein both sides of the second body member are flat, whereby adhesive coated sheet material may be pinched between one of the sharp edges and an adjacent flat surface.

6. A cleaner comprising:

first and second body members, each having first and second ends, the first and second body members being hinged together at their first ends to fold together about the hinge to abut along first and second sides of the body members to define an enclosure having an outer surface defined by the outer surfaces of the first and second body members, and to open about the hinge so that the outer surfaces of the first and second body members define a substantially continuous surface, the first and second body members having complementary snap members to snap together when folded together to form the enclosure;

a roll of adhesive coated sheet material, rolled adhesive coated side out, partially within the first body member and supported from the first and second ends of the first body member for rotation about its axis;

the roll of adhesive coated sheet material being slit adjacent one end thereof, the slit running only part way along its axis;

at least one side of one of the body members defining a sharp edge for pinching adhesive coated sheet material between the sharp edge and an adjacent side of the other body member to encourage tearing of the adhesive coated sheet material along the sharp edge when the adhesive coated sheet material is unrolled to place one of the slits in the roll adjacent the sharp edge.

7. The cleaner of claim 6 wherein the complementary snap members on the first and second body members to snap together when folded together to form the enclosure are complementary snap members at the first ends of the first and second body members.

8. The cleaner of claim 6 wherein the first and second body members are injection molded members and the sharp edge is a molded sharp edge.

9. The cleaner of claim 6 wherein the first ends of the first and second body members are configured to snap together to hold the body members in the open position.

10. The cleaner of claim 6 wherein both sides of one of the body members defines a sharp edge.

11. The cleaner of claim 10 wherein both sides of the second body member are flat, whereby adhesive coated sheet material may be pinched between one of the sharp edges and an adjacent flat surface.

12. A cleaner comprising:

first and second body members, each having first and second ends, the first and second body members being hinged together at their first ends to fold together about the hinge to abut along first and second sides of the body members to define an enclosure having an outer surface defined by the outer surfaces of the first and second body members, and to open about the hinge;

a roll of adhesive coated sheet material, rolled adhesive coated side out, partially within the first body member and supported from the first and second ends of the first body member for rotation about its axis;

the roll of adhesive coated sheet material being slit adjacent one end thereof;

at least one side of one of the body members defining a sharp edge for pinching adhesive coated sheet material between the sharp edge and an adjacent side of the other body member to encourage tearing of the adhesive coated sheet material along the sharp edge when the adhesive coated sheet material is unrolled to place one of the slits in the roll adjacent the sharp edge.

13. The cleaner of claim 12 wherein the first and second body members are injection molded members and the sharp edge is a molded sharp edge.

14. The cleaner of claim 12 wherein the first ends of the first and second body members are configured to snap together to hold the body members in the open position.

15. The cleaner of claim 12 wherein the first and second body members have complementary snap members adjacent their second ends to snap together when folded together to form the enclosure.

16. The cleaner of claim 12 wherein both sides of one of the body members defines a sharp edge.

17. The cleaner of claim 16 wherein both sides of the second body member are flat, whereby adhesive coated sheet material may be pinched between one of the sharp edges and an adjacent flat surface.

* * * * *